United States Patent [19]

McLendon

[11] 4,235,134

[45] Nov. 25, 1980

[54] ADJUSTABLE WRENCH

[76] Inventor: Thomas R. McLendon, 1108 Skrivanek, Bryan, Tex. 77801

[21] Appl. No.: 11,786

[22] Filed: Feb. 14, 1979

[51] Int. Cl.[3] ..... B25B 13/28

[52] U.S. Cl. ..... 81/91 C; 81/128; 279/37

[58] Field of Search ..... 81/91 R, 91 C, 128; 279/37, 107

[56] References Cited

U.S. PATENT DOCUMENTS

| | | | |
|---|---|---|---|
| 1,990,525 | 2/1935 | Chancellor | 279/37 |
| 2,592,037 | 4/1952 | Keiser | 81/91 C X |
| 2,745,305 | 5/1956 | Reiffin | 81/128 |
| 2,850,931 | 9/1958 | Conwax | 81/128 |
| 3,724,299 | 4/1973 | Nelson | 81/128 |

*Primary Examiner*—James G. Smith
*Attorney, Agent, or Firm*—Neal J. Mosely

[57] ABSTRACT

An adjustable wrench comprises a supporting member having a plurality of gripping arms pivotally supported thereon. The gripping arms are moveable into and out of engagement with a hex-headed nut or bolt. The apparatus may be modified to use two or four or eight arms for gripping square-headed or octagonally-headed nuts or bolts. Obviously, the gripping structure could also be used for gripping other objects, as in a drill chuck or lathe.

The apparatus has a second moveable member capable of rotary motion adjacent to the supporting member. The second moveable member has supported thereon a cylindrical cam member moveable longitudinally of said gripping arms and engageable with cam surfaces thereon to move said arms pivotally inward into gripping relation. Said second rotary moveable member and said supporting member for said gripping arms are provided with cooperating rotary cam surfaces operable to move said moveable member, upon rotation thereof in either direction, to move said cylindrical cam member longitudinally of said gripping arms.

Special details are also disclosed of the hinge connection between said gripping arms and said supporting members. Also, disclosed are details of an optional arrangement interconnecting said moveable members to prevent twisting movement thereof.

18 Claims, 7 Drawing Figures

ADJUSTABLE WRENCH

BACKGROUND OF THE INVENTION

1. Field of the Invention

This invention relates to new and useful inventions in gripping devices and more particularly to adjustable wrenches.

2. Brief Description of the Prior Art

A number of types of adjustable wrenches are known in the prior art. Adjustable wrenches having a pair of adjustable jaws are available commercially. One simple type of adjustable wrench is known as the monkey wrench. Another adjustable wrench is the pipe wrench which has an adjustable jaw and a pivotal arrangement whereby the action of the handle in tightening and turning also tends to clamp the jaws tighter together. Adjustable clamping devices which fit around an object from a variety of directions are known in the case of drill chucks and lathe chucks. The patent literature reports some examples of attempts to produce adjustable socket wrenches. None of these, however, have achieved any commercial acceptance.

Koziel U.S. Pat. No. 1,768,988 discloses a socket wrench which is adaptable to use with nuts of varying diameters. This wrench has an adjustable lug or lugs which require independent adjustment. Lugs are also difficult to install and provide a gripping action on only two sides of the nut being turned by the wrench.

Lafin U.S. Pat. No. 1,501,788 discloses a socket wrench having a pair of fixed jaws and an adjustably moveable jaw. The adjustment arrangement is handled by clamping bolts and nuts. This wrench would tend to loosen with use rather than to tighten.

Johnson U.S. Pat. No. 2,381,597 discloses an adjustable socket wrench which is specially designed for applying and removing nuts having slots for engagement with the wrench. The device functions somewhat similarly to screw driver rather than a wrench.

Leibowitz U.S. Pat. No. 2,764,050 discloses an adjustable socket wrench having three clamping arms operated by a rotary cam which engages the moveable arms and pivots the same into engagement with the nut being clamped. The cam arrangement, however, is such that it tends to twist the clamping arm about its pivot point during the clamping operation.

Rockwell U.S. Pat. No. 3,972,253 discloses a multisize socket wrench. This socket wrench has a fixed plate and a pair of adjustable jaws which are moveable against the nut or bolt head being clamped by the wrench. The jaws do not provide for a uniform clamping on the nut or bolt head with the clamping force being uniformly increased with rotation of the wrench.

SUMMARY OF THE INVENTION

One of the objects of this invention is to provide an improved adjustable wrench or clamping device which overcomes the difficiencies of the prior art.

Another object of this invention is to provide a new and improved adjustable socket wrench which clamps the bolt or nut on which the wrench is used with a uniform force from all sides.

Still another object of this invention is to provide an improved adjustable socket wrench in which the clamping surfaces clamp onto the nut or bolt being turned with increasing pressure as the wrench is turned.

Other objects of this invention will become apparent from time to time throughout the specification and claims as hereinafter related.

In order to overcome the problems of the prior art and achieve the foregoing objectives, an improved adjustable wrench or clamping device is provided. An adjustable wrench comprises a supporting member having a plurality of gripping arms pivotally supported thereon. The gripping arms are moveable into and out of engagement with a hexheaded nut or bolt. The apparatus may be modified to use two or four or eight arms for gripping square-headed or octagonally-head nuts or bolts. Obviously, the gripping structure could also be used for gripping other objects, as in a drill chuck or lathe.

The apparatus has a second moveable member capable of rotary motion adjacent to the supporting member. The second moveable member has supported thereon a cylindrical cam member moveable longitudinally of said gripping arms and engageable with any surfaces thereon to move said arms pivotally inward into gripping relation. Said second rotary moveable member and said supporing member for said gripping arms are provided with cooperating rotary cam surfaces operable to move said moveable member, upon rotation thereof in either direction, to move said cylindrical cam member longitudinally of said gripping arms.

Special details are also disclosed of the hinge connection between said gripping arms and said supporting members. Also, disclosed are details of an optional arrangement interconnecting said moveable members to prevent twisting movement thereof.

DESCRIPTION OF THE PREFERRED EMBODIMENT

Figure 1:
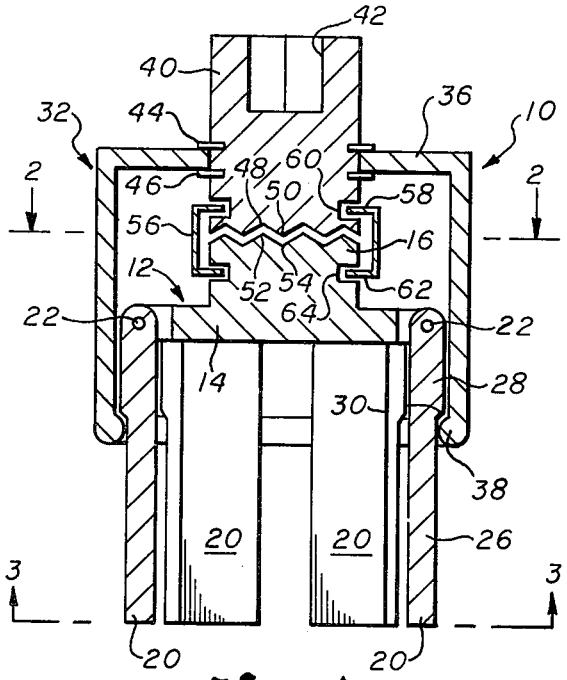
FIG. 1 is a view in longitudinal central section of an adjustable wrench constructed in accordance with this invention.
Figure 2:
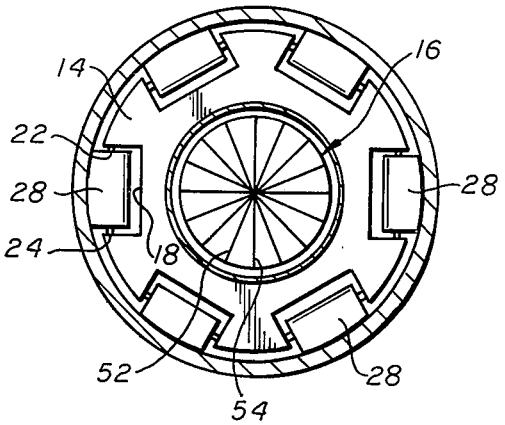
FIG. 2 is a top view of the supporting member for the clamping arms of the wrench.

Referring to the drawings by numeral of reference, and more particularly to FIG. 1, there is shown an adjustable wrench or clamping device 10 which clamps onto nuts or bolts or other objects to be secured over a substantial range of sizes. The wrench 10 includes a supporting member12 having a plurality of radially extending supporting arms 14 and a central longitudinally extending shaft portion 16.

Supporting arms 14 are spaced circumferentially from each other and define recesses or notches 18. A plurality of gripping arms 20 are supported on supporting member 12 with their respective upper ends positioned in notches 18 and supported on pivot pins 22 extending into recesses 24 in radially extending supporting arms 14. Pivot pins 22 would preferably be made in two sections with one being moveable longitudinally and spring loaded for installation in the same manner as the pin which connects a wrist band to a wrist watch.

Gripping arms 20 are spaced initially in a substantially parallel relation and are moveable pivotally inward and outward for adjustment relative to the nut or bolt head or other object to be clamped. The minimum size adjustment is limited by the point at which the gripping arms 20 engage each other on inward pivotal movement. The outer surface of gripping arms 20 is cylindrical, so that the several gripping arms when assembled in the adjustable wrench have their outer surfaces lying initially on a single cylindrical surface.

Gripping arms 20 each have a lower portion 26 of narrower cross-section, an upper portion 28 of wider cross-section and an inclined shoulder portion, or cam surface, interconnecting portions 26 and 28. Each of portions 26 and 28 and connecting shoulder or cam surface 30 has a circular curvature when looked at in end view. Each has a circular curvature having a common center.

The adjustable wrench 10 includes a longitudinally moveable cam member 32 which has a cylindrical side wall 34 and an end wall 36. Side wll 34 terminates at its lower end in rounded cam surface 38 which engages cam shoulder 30 on each of the gripping arms 20. The apparatus is provided with means for moving cam member 32 and cam surface 38 longitudinally in relation to gripping arms 20 to cause cam surface 38 to move on cam shoulder 30 and pivot gripping arms 20 into gripping engagement with a nut or bolt head or other object to be gripped. The amount of longitudinal movement of cam member 32 relative to gripping arms 20 determines the amount of pivotal movement of gripping arms 20 and thus the amount of adjustment to fit a hex nut or bolt head or other object of any particular size. A preferred means for movement of the cam member 32 is the camming arrangement shown in FIG. 1, although other suitable means could be used. The camming arrangement which is shown, and will be subsequently described, is one which effects longitudinal movement of cam member 32 to effect a clamping or gripping action of gripping arms 20 upon rotation of the wrench in either a tightening or a loosening direction.

Wrench 10 is provided with rotary drive shaft 40 having a drive socket 42, preferably square, to receive the drive pin of a wrench handle (not shown.) The apparatus is preferably used with a standard rachet handle for an ordinary socket wrench assembly. This adjustable socket wrench is therefore designed to fit any ordinary socket wrench operating handle and preferably a rachet type handle.

Cam member 32 is supported on rotary drive shaft 40 by flanges 44 and 46, which may be removable washers or may be fixed on the drive shaft. End wall 36 of cam member 32 may be supported in a fixed position on rotary drive shft 40 or may be free for rotary movement thereon if desired.

The bottom end of rotary drive shaft 40 is provided with a plurality of radially extending grooves 48 and shoulders 50. This provides arrangement of radially extending wedges or inclined planes which provide a camming action to be subsequently described. The end of longitudinally extending shaft 16 is likewise provided with a like arrangement of radially extending grooves 54 and shoulders 52 which are radially extending wedges. The radially extending shoulders 52 in shaft portion 16 fit into and mate with the notches 48 in drive shaft 40, while shoulders 50 of drive shaft 40 fit into and mate with notches 54 in shaft member 16. The shaft member 40 and supporting shaft 16 are secured loosely together by sleeve member 56 having an upper inturned flange 58 fitting into peripheral groove 60 and lower flange 62 fitting into peripheral groove 64. Grooves 60 and 64 and flanges 58 and 62 are loose fitting to allow for longitudinal relative movement of members 40 and 16 to the extent caused by rotation of the wedge surfaces relative to each other.

OPERATION

Figure 3:
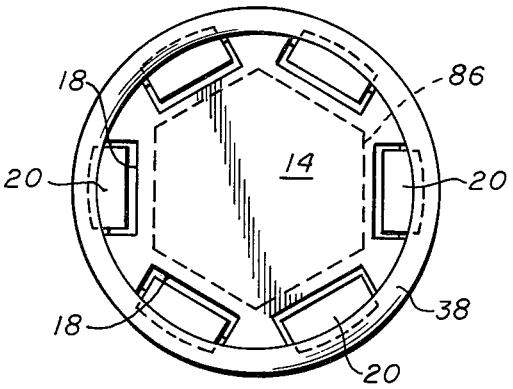
FIG. 3 is a bottom view of the wrench shown in FIG. 1.

In operation, this adjustable wrench is placed over a hex nut or bolt head 86, shown in dotted line in FIG. 3, with gripping arms spaced therefrom, as indicated. On rotation of shaft 40 by wrench handle (not shown), shaft 40 tends to rotate relative to shaft portion 16. This rotary motion causes the radially extending wedging surfaces, or cams, and the ends of members 40 and 16 to slide against each other and effect a longitudinal movement of shaft 40 relative to shaft 16. This longitudinal movement of shaft 40 moves cam member 32 longitudinally in relation to gripping arms 20. This longitudinal movement causes cam surfaces 38 to move along cam shoulders 30 on each of gripping arms 20 and effect inward pivotal movement of gripping arms 20.

In this mode of operation, gripping arms 20 will pivot inward until they engage hex nut or bolt head 66. At this point, further rotation of drive shaft 40 by wrench handle will start to twist the hex nut or bolt head and will tend to further tighten gripping arms 20 onto nut or bolt head 66. This increase in clamping action as the wrench is rotated functions similarly to the increased clamping action produced by the leverage of the wrench arm in a pipe wrench.

During the tightening operation, the cam surfaces at the joint between drive shaft 40 and shaft 16 are tightly engaged and the cam surface 38 is tightly engaged against cam shoulder 30. As a result, there is no tendency for the wrench to loosen or the gripping arms to slip back when the rotary tightening force is momentarily relieved as in the case of the backward movement of a rachet handle.

The arrangement of the grooves and shoulders providing the cooperating inclined planes or wedges which slide against each other at the lower end of shft 40 and upper end of shaft 16 is such that a like camming action takes place when the drive shaft 40 is rotated or turned in the opposite direction for loosening a nut or bolt head. When shaft 40 is turned in the opposite direction, the cam surfaces formed by the inclined planes or wedges similarly cause a longitudinal movement of shaft 40 relative to shaft portion 16, thus moving cam member 32 and causing cam surface 38 to move against cam shoulder 30 and pivot gripping arms 20 into tight engagement with the nut or bolt head being loosened.

DESCRIPTION OF ALTERNATE EMBODIMENTS

Figure 4:
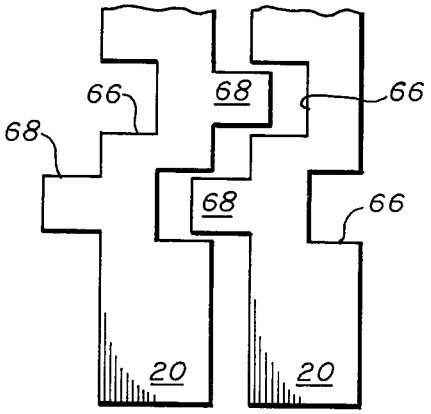
FIG. 4 is a detail view of the two of the clamping arms showing an optional arrangement to provide for mutual support of the arms against twisting movement during operation of the wrench.

In FIG. 4 there is shown an alternate embodiment of gripping arms 20. Each of the gripping arm 20 is provided with notches 66 and pins 68. When the device is assembled as shown in FIG. 1, pins 68 fit into notches 66 in each of the adjacent gripping arms and slide into and out of the notches with inward and outward movement of gripping arms 20. This arrangement causes gripping arms 20 to be locked together in movement as they pivot inward and outward. This arrangement secures gripping arms 20 to each other and relieves torque on pivot pins 22 during use of the wrench in tightening or loosening nuts or bolt heads.

Figure 5:
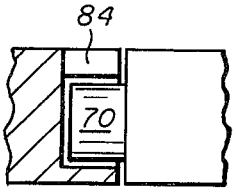
FIG. 5 is a detail view of an optional pivot pin and socket arrangement for supporting the clamping arms.
Figure 6:
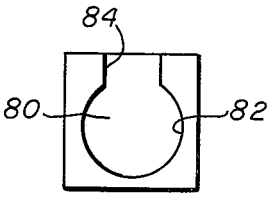
FIG. 6 is an end view of the pivot socket shown in FIG. 5.
Figure 7:
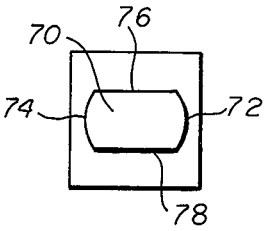
FIG. 7 is an end view of the pivot pin shown in FIG. 5.

In FIGS. 5, 6 and 7, there are shown details of a hinge pin connection for supporting gripping arms 20 on support members 14. In this arrangement pin member 70 has end portions 72 and 74 which are part of a common cylindrical surface. The side walls 76 and 78 of pin member 70 are flat and parallel to each other. Socket 80 which receives pin member 70 has a cylindrical wall 82 of the same radius as end walls 72 and 74 of pin 70. Socket 80 has an end opening 84 which has a width equal to the distance between flat parallel walls 76 and 78 of pin member 70. This arrangement permits pin member 70 to be inserted into socket 80 by sliding the same through opening 84 and then rotating pin 70 so it is secured in socket 80.

The pin and socket arrangement, just described, does not specify whether the pin is on the gripping arm or on the supporting arm. It is obvious that either arrangement is operative. This pin and socket arrangement may be used with a pair of pins intergal with and extending from the sides of gripping arms 20 and fitting into sockets on supporting arms 14. The device would function equally well with pins on supporting arms 14 fitting sockets on gripping arms 20.

The clamping and unclamping operation of the wrench as described above in connection with the preferred embodiment of the invention is indentical when using either of the alternate embodiments for the gripping arms 20 or for the pivot pin connection thereof to supporting arms 14.

While this invention has been described fully and completely with special emphasis upon certain preferred embodiments it should be understood that other obvious variations of the invention may be used without departing from the essential inventive concept. For example, other suitable means for moving cam member 32 longitudinally of gripping arms 20 may be used without departing from the basic inventive concept. It should therefore be understood that within the scope of the appended claims this invention may be practiced otherwise than as specifically described herein.

I claim:

1. A clamping apparatus comprising a plurality of elongated gripping arms, a rotatable member providing a plurality of equally spaced fulcrums supporting said gripping arms in substantially parallel relation for inward and outward pivotal movement, first cam means supported for longitudinal sliding movement relative to said gripping arms and engagable therewith to pivot said arms inward upon movement thereof in one direction, a drive member operatively connected to said rotatable member to rotate the same, and second cam means responsive to incremental movement of said drive member in either forward or backward direction to move said first cam means longitudinally in relation to said gripping arms to effect inward pivotal gripping movement thereby.

2. A clamping apparatus as described in claim 1 in which said movement responsive means comprises cam means on said rotatable member and cam means on said drive member cooperable therewith.

3. A clamping apparatus as described in claim 2 in which said first named cam means is supported on and movable with said drive member.

4. A clamping apparatus as described in claim 3 in which said first named cam means comprises a sleeve member surrounding said gripping arms and having a ring shaped cam surface engagable therewith.

5. A clamping apparatus as described in claim 4 in which each of said gripping arms has a cam shoulder engaged by said ring shaped cam surface.

6. An adjustable socket wrench comprising a plurality of elongated gripping arms, a rotatable member providing a plurality of equally spaced fulcrums supporting said gripping arms in substantially parallel relation for inward and outward pivotal movement with respect to a nut or bolt head to be gripped, first cam means supported for longitudinal sliding movement reative to said gripping arms and engagable therewith to pivot said arms into gripping engagement upon movement thereof in one direction, a drive member for turning said wrench operatively connected to said rotatable member to rotate the same, and second cam means responsive to incremental turning movement of said drive member in either forward or backward direction to move said first cam means longitudinally in relation to said gripping arms to effect inward pivotal gripping movement thereby.

7. An adjustable socket wrench as described in claim 6 in which said movement responsive means comprises cam means on said rotatable member and cam means on said drive member cooperable therewith.

8. An adjustable socket wrench as described in claim 7 in which said first named cam means is supported on and movable with said drive member.

9. An adjustable socket wrench as described in claim 8 in which said first named cam means comprises a sleeve member surrounding said gripping arms and having a ring shaped cam surface engagable therewith.

10. An adjustable socket wrench as described in claim 9 in which each of said gripping arms has a cam shoulder engaged by said ring shaped cam surface.

11. An adjustable socket wrench as described in claim 6 in which said rotatable member and said drive member each have cam surfaces formed in the ends thereof comprising radially extending grooves and shoulders with the groove on one member fitting the shoulder on the other whereby rotary movement of one member relative to the other in either forward or backward direction will effect a sliding movement of the shoulders relative to the grooves and move said drive member longitudinally in relation to said gripping arms.

12. An adjustable socket wrench as described in claim 11 in which said grooves and shoulders are inclined planes.

13. An adjustable socket wrench as described in claim 11 including supporting means securing said drive member and said rotatable member loosely together and permitting relative rotary movement therebetween.

14. An adjustable socket wrench as described in claim 13 in which said supporting means is a sleeve member surrounding and secured to the cooperating ends of said drive member and said rotatable member.

15. An adjustable socket wrench as described in claim 6 including means interconnecting said gripping arms to effect pivotal movement thereof in unison.

16. An adjustable socket wrench as described in claim 15 in which said interconnecting means comprises a pin member integral with and extending from each of said gripping arms and slidably fitting a notch in the adjacent gripping arm.

17. An adjustable socket wrench as described in claim 6 in which the number of gripping arms is even.

18. An adjustable socket wrench as described in claim 6 in which there are six gripping arms.

* * * * *